US008690478B2

(12) United States Patent
Kim

(10) Patent No.: US 8,690,478 B2
(45) Date of Patent: Apr. 8, 2014

(54) TUNNEL REINFORCEMENT STRUCTURE AND TUNNEL CONSTRUCTION METHOD CAPABLE OF CONTROLLING GROUND DISPLACEMENT USING PRESSURIZATION

(75) Inventor: Dae Young Kim, Gyeonggi-do (KR)

(73) Assignee: Hyundai Engineering & Construction Co., Ltd. (KR)

( * ) Notice: Subject to any disclaimer, the term of this patent is extended or adjusted under 35 U.S.C. 154(b) by 162 days.

(21) Appl. No.: 13/271,907

(22) Filed: Oct. 12, 2011

(65) Prior Publication Data

US 2012/0107049 A1 May 3, 2012

(30) Foreign Application Priority Data

Oct. 28, 2010 (KR) ..... 10-2010-0106286
Oct. 28, 2010 (KR) ..... 10-2010-0106289

(51) Int. Cl.
*E21D 11/00* (2006.01)

(52) U.S. Cl.
USPC ..... 405/150.1; 405/272

(58) Field of Classification Search
USPC ..... 405/132, 134, 135, 138, 150.1, 150.2, 405/151, 152
See application file for complete search history.

(56) References Cited

U.S. PATENT DOCUMENTS

| | | | | | |
|---|---|---|---|---|---|
| 1,800,819 | A | * | 4/1931 | Donaldson | 405/139 |
| 4,120,164 | A | * | 10/1978 | Tomlin | 405/289 |
| 4,363,565 | A | * | 12/1982 | MacKenzie | 405/146 |
| 4,459,064 | A | * | 7/1984 | Berset | 405/138 |
| 4,786,206 | A | * | 11/1988 | Yamamoto et al. | 405/146 |
| 2003/0143036 | A1 | * | 7/2003 | Larsen, Jr. | 405/232 |

FOREIGN PATENT DOCUMENTS

| | | | |
|---|---|---|---|
| JP | 01165813 | A * | 6/1989 |
| JP | 05044397 | A * | 2/1993 |
| JP | 2002180459 | A * | 6/2002 |

* cited by examiner

*Primary Examiner* — David Bagnell
*Assistant Examiner* — Kyle Armstrong
(74) *Attorney, Agent, or Firm* — Akerman LLP

(57) ABSTRACT

The present invention relates to a tunnel reinforcement structure capable of controlling ground displacement using pressurization, including: reinforcements adapted to be forcedly inserted into the bored holes formed along the outer surface of the section to be excavated of the tunnel; auxiliary reinforcements disposed between the reinforcements from a point between 4 m and 8 m inwardly from the ends of the reinforcements; steel ribs disposed on the inner four faces of the excavation face of the tunnel; pressurizing bags each provided between the steel ribs and the excavated inner surface of the tunnel; a concrete part adapted to be cast between the steel ribs; and lining concrete adapted to be cast to the steel ribs and the inner surface of the concrete part.

6 Claims, 19 Drawing Sheets

TUNNEL REINFORCEMENT STRUCTURE AND TUNNEL CONSTRUCTION METHOD CAPABLE OF CONTROLLING GROUND DISPLACEMENT USING PRESSURIZATION

CROSS-REFERENCE TO RELATED APPLICATIONS

The present application claims priority to Korean Patent Application No. 10-2010-0106286, filed Oct. 28, 2010 and Korean Patent Application No. 10-2010-0106289, filed Oct. 28, 2010, the entirety of which are incorporated herein by reference.

BACKGROUND OF THE INVENTION

1. Field of the Invention

The present invention relates to a tunnel reinforcement structure and a tunnel construction method, and more particularly, to a tunnel reinforcement structure and a tunnel construction method capable of controlling displacement using pressurization, wherein a pressurizing bag is provided between the excavated inner surface of the ground and steel ribs so as to recover or to the highest degree restrain the ground displacement and ground surface settlement occurring around an excavation face of the tunnel.

Further, the present invention relates to a tunnel reinforcement structure and a tunnel construction method capable of controlling displacement using pressurization, wherein reinforcements and face bolts resist the external forces applied in a vertical or horizontal direction and the external forces locally generated, during excavation, as an integral body with each other, thereby improving the stability of the excavation.

2. Background of the Related Art

According to the excavation work carried out to pass through the ground under a given structure like expressways or railways, generally, steel pipes having a diameter of more than 800 mm are first forcedly inserted into the ground for tunnel excavation, and next, steel pipes are penetratedly arranged in the excavation process of the soil inside the inserted steel pipes. As the above processes are repeatedly carried out, the plurality of steel pipes is disposed to surround the outside of a concrete box structure to be installed, and after the steel pipes adjacent horizontally to each other are connected, concrete is cast to them.

After the steel pipes into which the concrete is filled are disposed on the ground, next, the soil surrounded by the steel pipes are excavated, thereby building the concrete box structure in the excavated space surrounded by the steel pipes. According to such conventional construction method, the large diameter steel pipes with large stiffness having a diameter of more than 800 mm are first installed before the excavation for construction of the concrete box structure, so as to prevent ground displacement from occurring during the excavation.

According to the conventional construction method, however, a relatively large construction area is needed to install a reaction force plate, an oil jack and the like as used for steel pipe jacking, and high construction costs and long construction period are also needed because of the installation of very expensive large diameter steel pipes and the excavation and welding carried out under the steel pipes.

SUMMARY OF THE INVENTION

Accordingly, the present invention has been made in view of the above-mentioned problems occurring in the prior art, and it is an object of the present invention to provide a tunnel reinforcement structure and a tunnel construction method capable of controlling displacement using pressurization, wherein a pressurizing bag is provided in a gap between the excavated inner surface of the ground and steel ribs, and to apply not only to the tunnel under a given structure but to the bored tunnel (hereafter referred to as tunnel), and is then filled with cement milk to pressurize the ground, thereby recovering the ground displacement occurred by the excavation around an excavation face and thereby to the highest degree restraining ground displacement and ground surface settlement through the improvement of the stiffness of the ground recovered by the pressurization of the pressurizing bag.

It is another object of the present invention to provide a tunnel reinforcement structure and a tunnel construction method capable of controlling displacement using pressurization, wherein reinforcements and face bolts resist the external forces applied in a vertical or horizontal direction and the external forces locally generated, during excavation, as an integral body with each other, thereby improving the stability in the excavation.

To accomplish the above objects, according to the first aspect of the present invention, there is provided a tunnel reinforcement structure capable of controlling displacement using pressurization so as to maintain the stability of the excavated section of tunnel during excavation, the tunnel reinforcement structure including: a plurality of reinforcements adapted to be forcedly inserted into the bored holes formed along the outer surface of the section to be excavated in one direction or in both directions in such a manner as to be arranged parallel to an excavation direction, so as to safely control the displacement of the ground, each of the reinforcements having a diameter in a range between 50 mm and 300 mm and a length in a range between 12 m to 40 m and the interior of each reinforcement having cement milk injected therein; a plurality of auxiliary reinforcements disposed between the reinforcements from a point between 4 m and 8 m inwardly from the ends of the reinforcements forcedly inserted into the ground in such a manner as to be inclined by 8° to 12° from an excavation face, if the total excavation length is longer than length of one or two reinforcements; a plurality of steel ribs disposed on the inner four (i.e. upper, lower and both sides) faces of the excavation face along the inner wall surfaces of the ground during the excavation; a plurality of pressurizing bags each provided between the steel ribs and the excavated inner surface of the ground so as to recover the displacement occurring through the excavation, the interior of each pressurizing bag having cement milk injected thereinto; a concrete part adapted to be cast between the steel ribs; and lining concrete adapted to be cast to the steel ribs and the inner surface of the concrete part, wherein the reinforcements are forcedly inserted into the outer surface of the section to be excavated on the ground in such a manner as to be spaced apart from each other by a distance between a diameter of each auxiliary reinforcement and 100 cm in a parallel direction to the excavation direction of the tunnel or in an outward direction of less than 10°.

According to the present invention, preferably, the steel ribs are steel beams.

According to the present invention, preferably, each of the pressurizing bags is made of any one selected from rubber, nylon, polyester and geo-textile in which fiber reinforcements are contained.

According to the present invention, preferably, each of the pressurizing bags has a shape of a bag whose inside is empty and inlets formed on one side thereof, into which the cement milk is injected.

According to the present invention, preferably, each of the pressurizing bags is attached to the flange portions of the steel ribs by means of fastener tape or adhesive.

According to the present invention, preferably, the concrete part includes: a wire mesh or steel cage adapted to be inserted between the adjacent steel ribs; and shotcrete or concrete adapted to be cast to the outside of the wire mesh or steel cage.

According to the present invention, preferably, the concrete part comprises shotcrete in which steel fibers are contained, and the lining concrete makes use of precast concrete.

According to the present invention, preferably, post steel ribs are further installed to support one side of centers of the steel ribs disposed on the bottom and top of the excavation face, so as to prevent the excavated portion of the tunnel from collapsing.

According to the present invention, preferably, the post steel ribs are removed in the casting process of the lining concrete.

To accomplish the above objects, according to the second aspect of the present invention, there is provided a tunnel construction method capable of controlling displacement using pressurization so as to excavate the tunnel, the tunnel construction method including the steps of: (a) forcedly inserting a plurality of reinforcements into the bored holes formed along the outer surface of the section to be excavated of the tunnel in one direction or in both directions, so as to safely control the displacement of the ground, each of the reinforcements having a diameter in a range between 50 mm and 300 mm and a length in a range between 12 m to 40 m; (b) injecting a reinforcement material in which cement milk is contained into the interior of each reinforcement; (c) mounting a plurality of face bolts on an excavation face in an excavation direction so as to prevent the excavation face from collapsing or being displaced; (d) excavating the tunnel; (e) installing steel ribs on the excavated area of the tunnel; (f) mounting a pressurizing bag between the steel ribs and the excavated inner surface of the tunnel and injecting cement milk into the pressurizing bag to pressurize the pressurizing bag; (g) inserting a steel cage between the adjacent steel ribs and casting shotcrete to the steel cage; (h) installing a plurality of auxiliary reinforcements disposed between the reinforcements from a point between 4 m and 8 m inwardly from the ends of the reinforcements forcedly inserted into the ground in such a manner as to be inclined by 8° to 12° from the excavation face, if the total excavation length is longer than length of one or two reinforcements; (i) injecting the reinforcement material into the auxiliary reinforcements installed inclinedly; and (j) after the steps (d) to (g) are repeatedly carried out until the excavation is finished, casting lining concrete to the steel ribs and the inner surface of the shotcrete, wherein the step (a) the reinforcements are forcedly inserted into the bored holes formed along the outer surface of the section to be excavated in such a manner as to be spaced apart from each other by a distance between a diameter of each auxiliary reinforcement and 100 cm in a parallel direction to the excavation direction of the tunnel.

According to the present invention, preferably, the face bolts are mounted spaced apart from one another by a distance between 1 m and 2 m.

According to the present invention, preferably, the step (e) further comprises the step of (e') installing a post steel rib tom installed to support one side of centers of the steel ribs disposed on the bottom and top of the excavation face, so as to prevent the excavated portion of the tunnel from collapsing.

According to the present invention, preferably, at the time of the step (j), the post steel ribs are removed sequentially in the casting process of the lining concrete or are removed all after the casting of the lining concrete.

According to the present invention, preferably, after the step (i), the steps (d) to (i) are repeatedly carried out until the excavation is finished.

According to the present invention, preferably, all of the steps are carried out in one direction or in both directions.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, an explanation on the tunnel reinforcement structure and a tunnel construction method capable of controlling displacement using pressurization according to the present invention will be in detail given with reference to the attached drawing.

[Configuration of the Invention]

Figure 1:
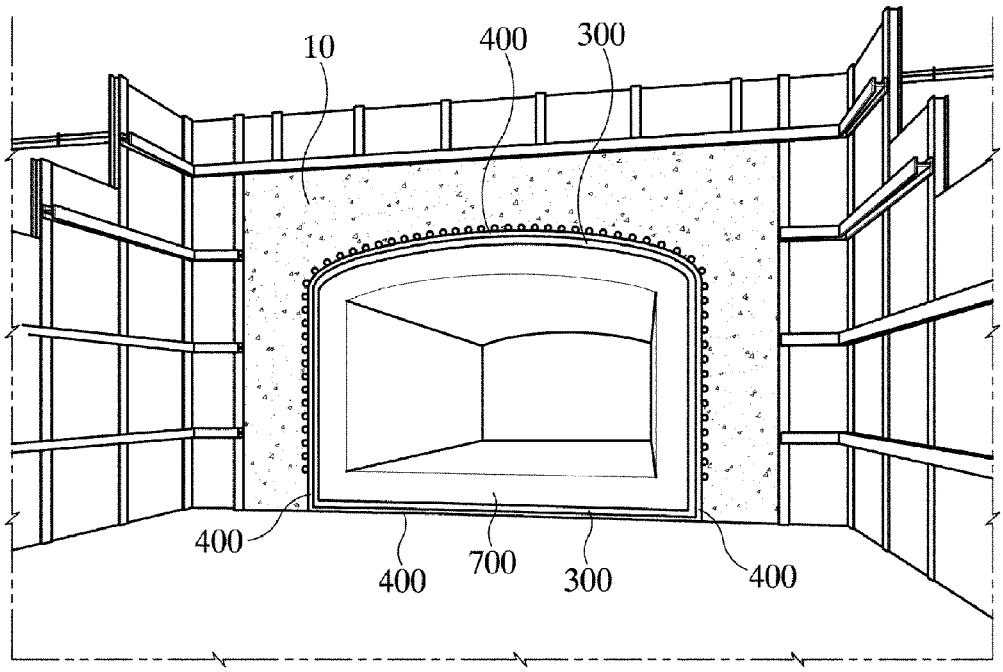
FIG. 1 is a front view showing a tunnel reinforcement structure capable of controlling displacement using pressurization according to the present invention.
Figure 2:
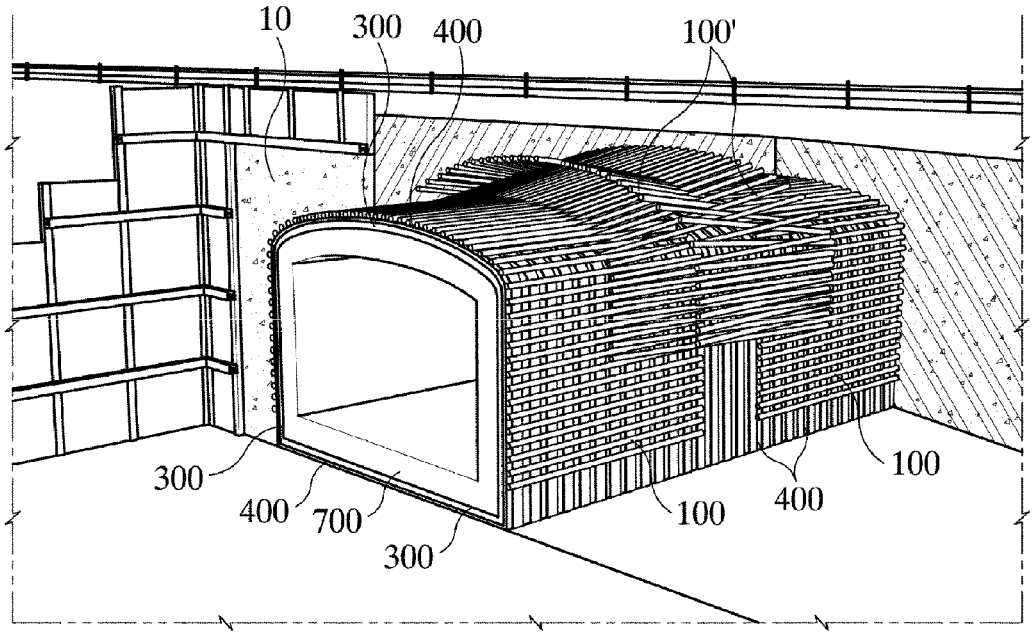
FIG. 2 is a perspective view showing the tunnel reinforcement structure, capable of controlling displacement using pressurization according to the present invention, which is partially cut away.
Figure 3:
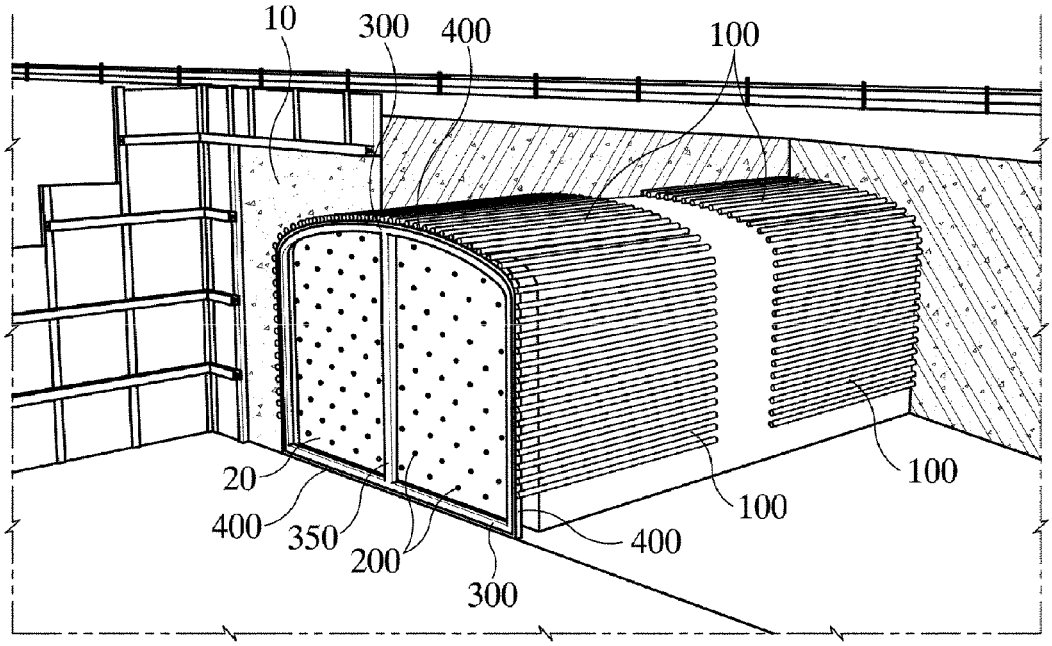
FIG. 3 is a perspective view showing a process of installing steel ribs in the tunnel reinforcement structure according to the present invention, which is partially cut away.

FIG. 1 is a front view showing the tunnel reinforcement structure capable of controlling displacement using pressurization according to the present invention, FIG. 2 is a perspective view showing the tunnel reinforcement structure capable of controlling displacement using pressurization according to the present invention, which is partially cut away, and FIG. 3 is a perspective view showing a process of installing steel ribs in the tunnel reinforcement structure according to the present invention, which is partially cut away.

As shown in FIGS. 1 and 2, the tunnel reinforcement structure capable of controlling displacement using pressurization according to the present invention largely includes reinforcements 100, steel ribs 300, pressurizing bags 400, and a concrete part and lining concrete 700.

According to the present invention, the reinforcements 100 are adapted to safely excavate the tunnel, while controlling the displacement occurring during the excavation. As shown in FIGS. 2 and 3, the reinforcements 100 are forcedly inserted into the bored holes formed along the outer surface of an excavation face 20 to be excavated in such a manner as to be arranged parallel to an excavation direction. Each of the reinforcements 100 makes use of a steel pipe having a diameter in a range between 50 mm and 300 mm and a length in a range between 12 m to 40 m. Also, the reinforcements 100 are arranged spaced apart from one another by a distance between 0 cm and 100 cm along the vertical section of the excavation face 20 on the outer surface of the required excavation section in such a manner as to be arranged parallel to the excavation direction of the tunnel. At this time, the interior of each reinforcement 100 is filled with a reinforcement material having cement milk contained therein so as to improve the stiffness of the reinforcement and the surrounding ground. Also, the excavation face 20 of the tunnel has face bolts 200, soil nails, or small-diameter reinforcements additionally mounted thereon so as to prevent falling forward.

Further, if the length of the tunnel is longer than the length of one or two reinforcements 100, auxiliary reinforcements 100' are additionally disposed between the respective reinforcements 100 from a point between 4 m and 8 m inwardly from the ends of the reinforcements 100 in such a manner as to be inclined by 8° to 12° from the excavation face 20. The lengths and diameters of the auxiliary reinforcements 100' are the same as the reinforcements 100, and in the same manner as above, the interior of each auxiliary reinforcement 100' is filled with a reinforcement material having cement milk contained therein. As the reinforcements 100 and the auxiliary reinforcements 100' are misaligned to one another, like this, they resist the external forces applied in a vertical or horizontal direction and the external forces locally generated, during excavation, as an integral body with each other, thereby improving the stability in the excavation.

If the length of the tunnel corresponds to the length of one or two reinforcements 100, however, there is no need for the installation of the auxiliary reinforcements 100'.

According to the present invention, as shown in FIGS. 1 to 3, the steel ribs 300 are disposed on the four faces of the excavation face 20 of the tunnel, that is, on the inner both sides, bottom, and top of the excavation face 20 so as to maintain the shape of the section of the excavation face 20 excavated. The steel ribs 300 are arranged spaced apart from one another by a distance between 50 cm and 100 cm on the excavation face 20 of the tunnel. The steel ribs 300 make use of steel ribs like H-beams having smaller stiffness than conventional steel pipes, and alternatively, they may make use of steel pipes having a smaller diameter than existing large steel pipes except for the H-beams. Also, the steel ribs 300 may be at a time disposed after the tunnel has been excavated, and alternatively, the processes of installing the steel ribs 300 may be repeatedly performed whenever the excavation face 20 is excavated by a given distance in accordance with the installation environments, the width of the excavation face 20 and the quality of the soil. When considering the installation environments, the width of the excavation face 20, and the quality of the soil, on the other hand, if there is a danger wherein an excavated portion of the tunnel collapses, post steel ribs 350 are further installed to support one sides of centers of the steel ribs 300 disposed on the bottom and top of the excavation face 20, thereby supporting the steel ribs 300 disposed on the top of the excavation face 20. The post steel ribs 350 make use of beams like H-beams that are the same as the steel ribs 300. The post steel ribs 350 may still exist or may be removed in the casting process of the lining concrete 700 as will be discussed later in accordance with the use environments of the ground or tunnel under the given structure.

Figure 4:
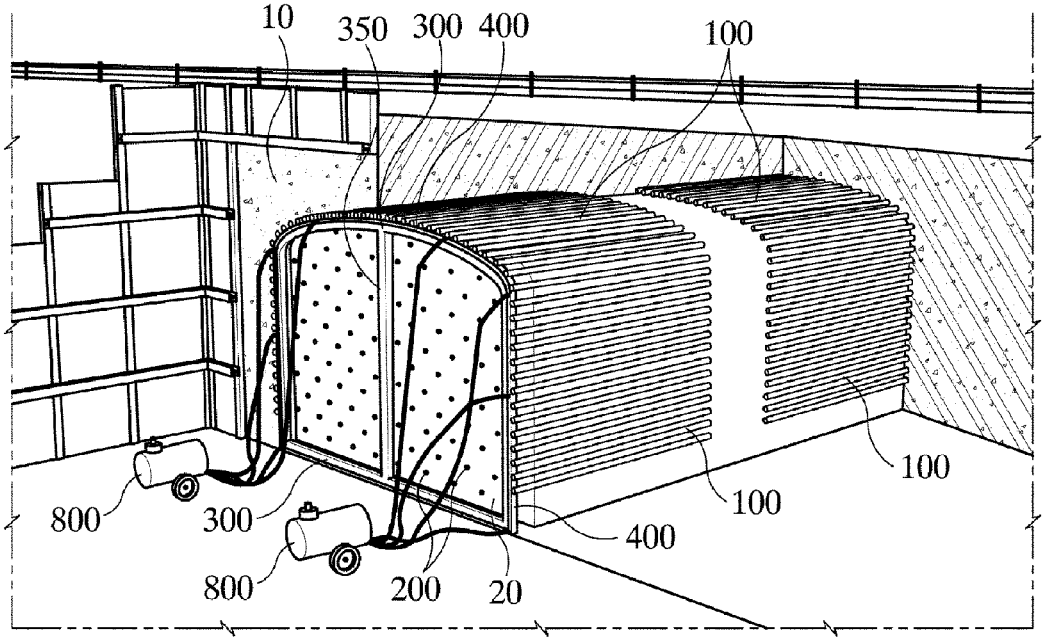
FIG. 4 is a perspective view showing a process of injecting cement milk into a pressurizing bag in the tunnel reinforcement structure according to the present invention, which is partially cut away.

FIG. 4 is a perspective view showing a process of pouring cement milk into a pressurizing bag in the tunnel reinforcement structure according to the present invention, which is partially cut away. According to the present invention, each of the pressurizing bags 400 is provided between the steel ribs 300 and the excavated inner surface of the ground so as to recover the displacement of the excavation face 20 occurring through the excavation. The pressurizing bag 400 may be inserted between the outer surfaces of the steel ribs 300 and the excavated inner surface after the steel ribs 300 have been installed, and alternatively, it may be installed together with the steel ribs 300, while being attached to the flange portions of the steel ribs 300 by means of fastener tape or adhesive so as to enhance its attaching force. As shown in FIG. 4, the interior of the pressurizing bag 400 is filled with cement milk and pressurized by means of cement milk injection devices 800. The pressurizing bag 400 may make use of one selected from nylon, polyester and geo-textile each having fine tissues through which water discharged in the hardening process of the cement easily flows and the cement particles are not penetrated, and alternatively, it may make use of rubber having an exhaust pipe formed thereon, in which fiber reinforcements are contained. The pressurizing bag 400 has a shape of a bag whose inside is empty and inlets formed on one side thereof, into which the cement milk is injected.

If the cement milk is injected into the pressuring bag 400, at this time, the internal pressure of the pressurizing bag 400 becomes gradually increased. The size of the internal pressure thereof corresponds to the size of the outward expansion of the inner surface of the tunnel with the repulsive force of the steel ribs 300. The internal pressure may be varied in accordance with the stiffness of an excavation ground 10, the height of the soil cover on the top of the tunnel, and the allowance load of the steel ribs 300. Further, the pressurizing bag 400 is pressurized within the range wherein the addition of the ground load and the pressurizing force occurring through the advancement of the face of the tunnel is less than the allowance load of the steel ribs 300.

According to the present invention, the concrete part is composed of a wire mesh or steel cage 500 adapted to be inserted between the adjacent steel ribs 300 and shotcrete 600 or concrete adapted to be cast to the outside of the wire mesh or steel cage 500.

Figure 5:
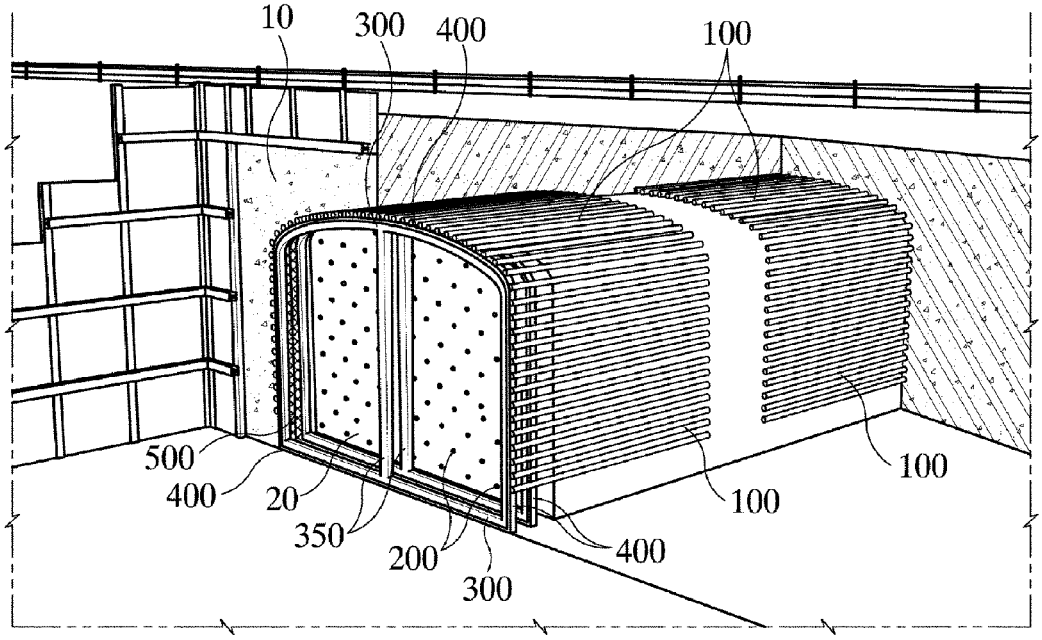
FIG. 5 is a perspective view showing a state wherein a steel cage is inserted between the steel ribs in the tunnel reinforcement structure according to the present invention, which is partially cut away.

FIG. 5 is a perspective view showing a state wherein a steel cage is inserted between the steel ribs in the tunnel reinforcement structure according to the present invention, which is partially cut away. The steel cage 500 of the present invention or the wire mesh is inserted between the adjacent steel ribs 300, as shown.

Figure 6:
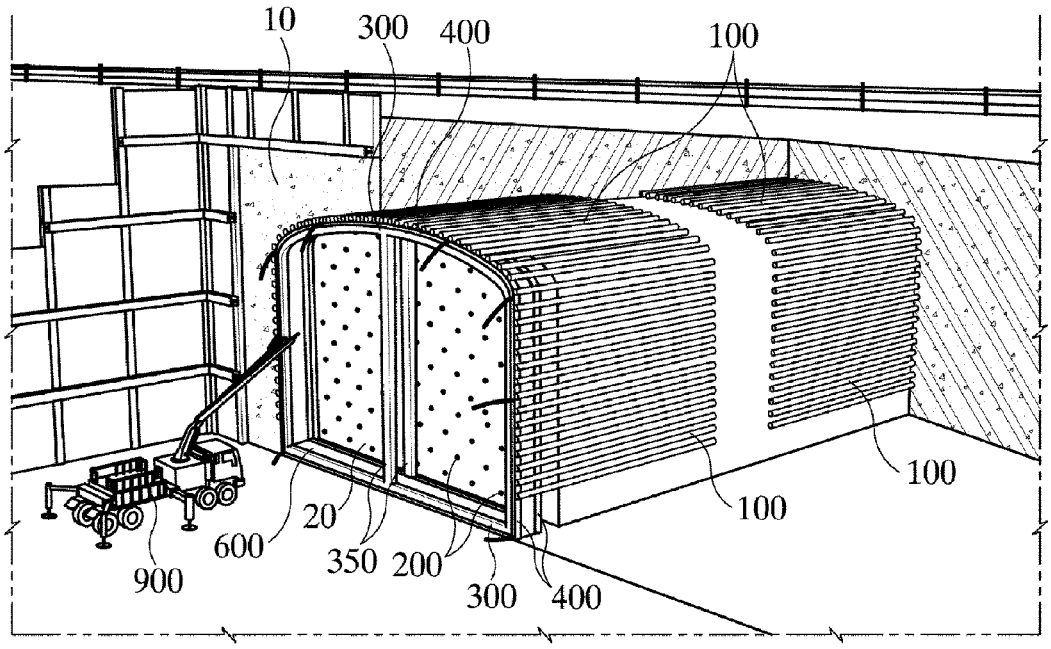
FIG. 6 is a perspective view showing a state wherein shotcrete is cast to the steel cage inserted into the steel ribs in the tunnel reinforcement structure according to the present invention, which is partially cut away.

FIG. 6 is a perspective view showing a state wherein shotcrete is cast to the steel cage inserted into the steel ribs in the tunnel reinforcement structure according to the present invention, which is partially cut away. As shown in FIG. 6, the shotcrete 600 is cast by a height of the steel rib 300 to the position where the steel cage 500 is inserted by means of a shotcrete casting device 900. Instead of the casting of the shotcrete 600, however, mold may be installed to cast concrete thereto in accordance with construction site states and installation conditions.

According to the present invention, further, the concrete part may include the shotcrete 600 in which steel fibers are contained adapted to be cast to reduce the installation time thereof, thereby removing the process of installing the steel cage 500 or the wire mesh and achieving the simplification of the procedure of the construction.

According to the present invention, the lining concrete 700 is cast to the steel ribs 300 and the inside of the shotcrete 600 cast between the steel ribs 300. If the post steel ribs 350 are installed, at this time, the lining concrete 700 is cast to the outer surfaces of the post steel ribs 350 or cast only to the steel ribs 300 and the inside of the shotcrete 600 after the removal of the post steel ribs 350 in accordance with the use patterns of the ground or tunnel under the given structure.

The lining concrete 700 is desirably replaced with precast concrete manufactured in a factory so as to reduce a construction cost and a period of construction. Of course, the lining concrete 700 may be directly cast in the construction site in consideration of the construction site states.

[Construction Method]

Figure 7:
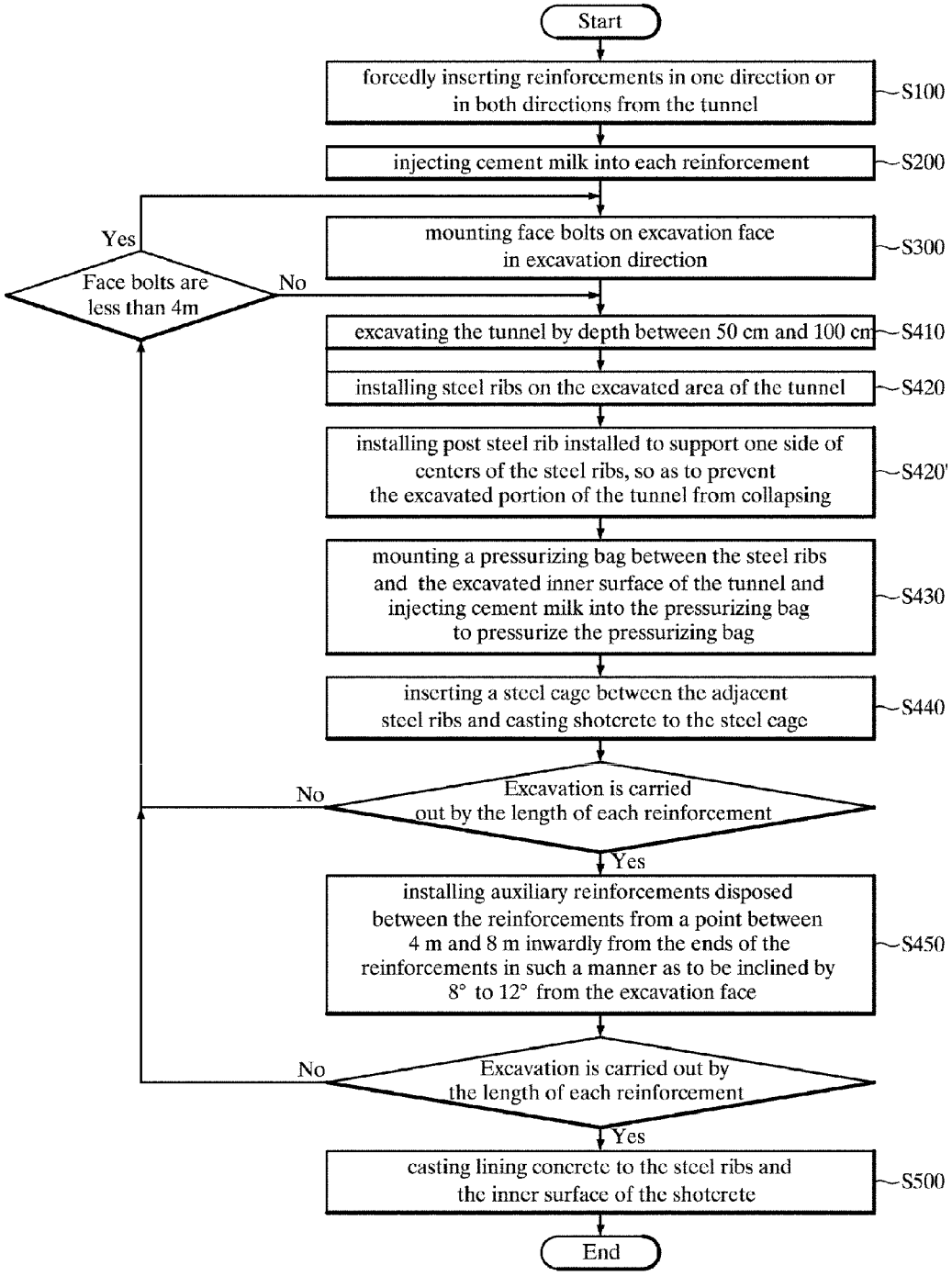
FIG. 7 is a flow chart showing a tunnel construction method capable of controlling displacement using pressurization according to the present invention.
Figure 8:
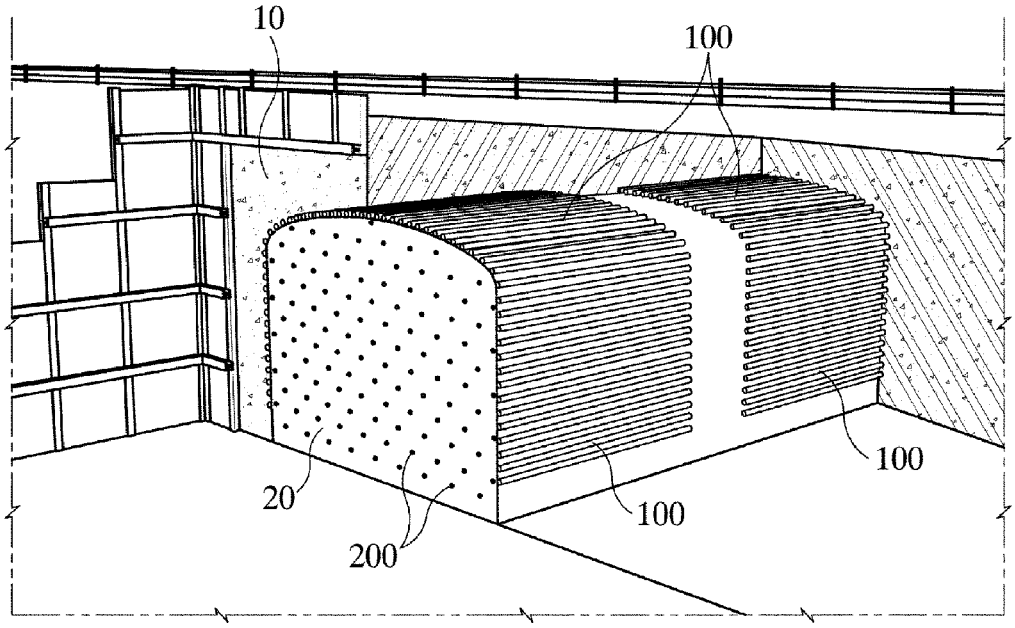
FIG. 8 is a perspective view showing steps 1 to 3 in the tunnel construction method according to the present invention, which is partially cut away.
Figure 9:
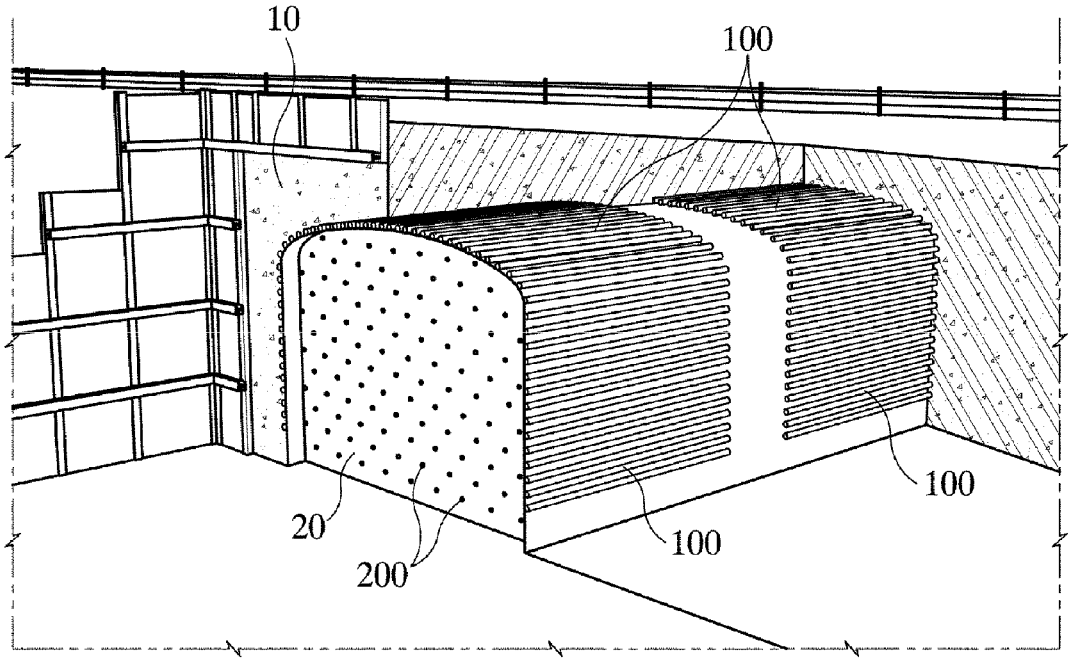
FIG. 9 is a perspective view showing a step 4-1 in the tunnel construction method according to the present invention, which is partially cut away.

FIG. 7 is a flow chart showing a tunnel construction method capable of controlling displacement using pressurization according to the present invention, FIG. 8 is a perspective view showing steps 1 to 3 in the tunnel construction method according to the present invention, which is partially cut away, and FIG. 9 is a perspective view showing a step 4-1 in the tunnel construction method according to the present invention, which is partially cut away.

So as to safely excavate the tunnel under the control of the displacement occurring during excavation, as shown in FIGS. 7 to 9, reinforcements 100 are forcedly inserted into the bored holes formed along the outer surface of an excavation face 20 to be excavated in such a manner as to be arranged parallel to an excavation direction (at step S100). At this time, each reinforcement 100 makes use of a steel pipe having a diameter in a range between 50 mm and 300 mm and a length in a range between 12 m to 40 m, and it may make use of a steel beam, if necessary. Also, the reinforcements 100 are arranged spaced apart from one another by a distance between 0 cm and 100 cm along the vertical section of the excavation face 20 on the outer surface of the required excavation section in such a manner as to be arranged parallel to the excavation direction of the tunnel. As a result, the reinforcements 100 resist the external forces applied in a vertical or horizontal direction and the external forces locally generated; during excavation, as an integral body with each other, thereby improving the stability in the excavation.

Next, the interior of each reinforcement 100 forcedly inserted around the excavation face 20 is filled with a reinforcement material having cement milk contained therein so as to improve the stiffness of the reinforcement 100 (at step S200).

After that, as shown in FIGS. 8 and 9, so as to prevent the excavation face 20 from collapsing during the excavation of the tunnel, face bolts 200 each having a length of about 12 m are installed on the excavation face 20 in such a manner as to be arranged parallel to the excavation direction of the tunnel (at step S300). At this time, the face bolts 200 are arranged spaced apart from one another by a distance of 1 m to 2 m on the excavation face 20 so as to prevent the excavation face 20 from falling forward during the excavation. As the face bolts 200 are installed on the front surface of the excavation face 20, they support the soil inside the excavation face 20 and prevent the soil from falling forward.

FIG. 9 is a perspective view showing the step 4-1 in the tunnel construction method according to the present invention, which is partially cut away. As shown in FIG. 9, the excavation face 20 is excavated to a depth of 50 cm to 100 cm on an excavation ground 10 so as to excavate the tunnel (at step S410). If the excavation face 20 is excavated too deeply at a time, it may collapse, and therefore, it is first excavated by a depth in which steel ribs 300 as will be discussed later can be installed.

Figure 10:
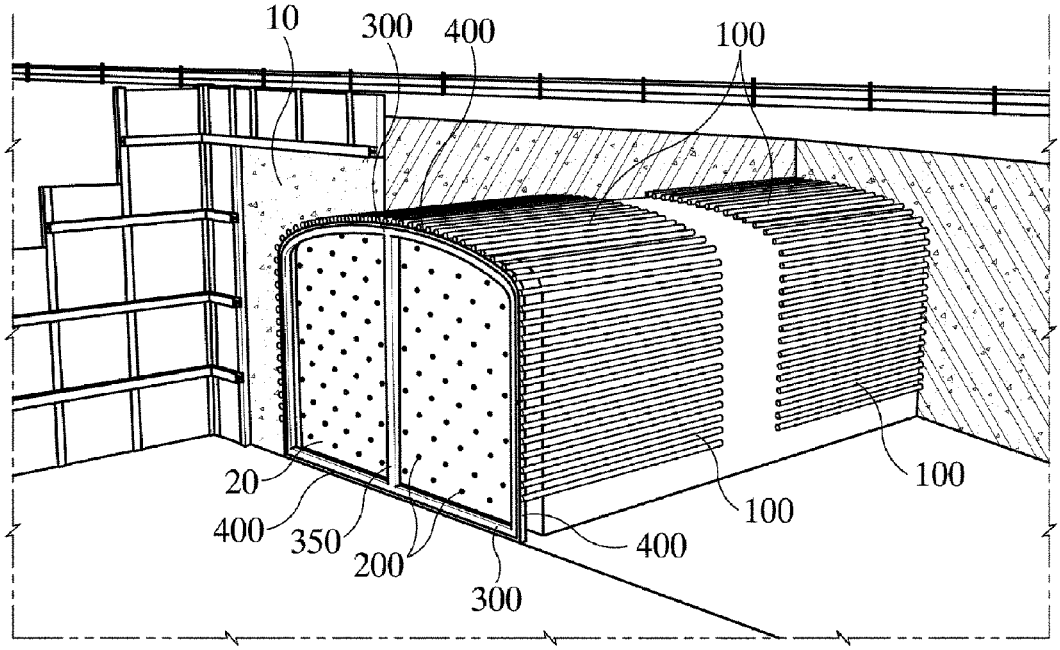
FIG. 10 is a perspective view showing steps 4-2 and 4-3 in the tunnel construction method according to the present invention, which is partially cut away.
Figure 11:
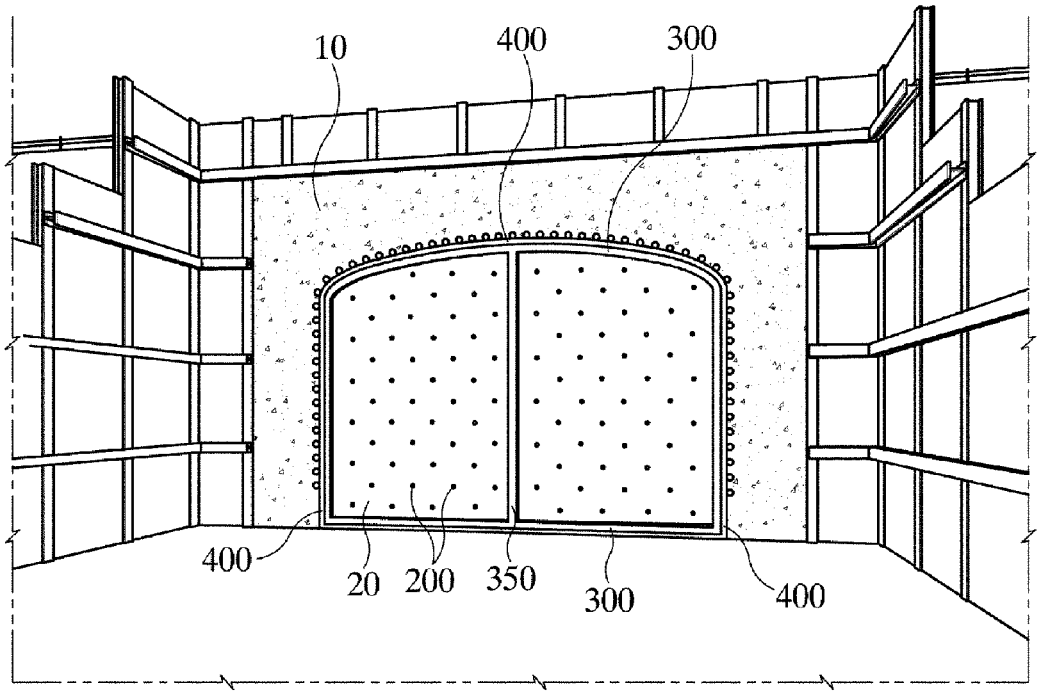
FIG. 11 is a front view showing the steps 4-2 and 4-3 in the tunnel construction method according to the present invention.

FIG. 10 is a perspective view showing steps 4-2 and 4-3 in the tunnel construction method according to the present invention, which is partially cut away, and FIG. 11 is a front view showing the steps 4-2 and 4-3 in the tunnel construction method according to the present invention. The steel ribs 300 are disposed on the four faces of the excavation face 20 of the tunnel, that is, on the inner both sides, bottom, and top of the excavation face 20 so as to maintain the shape of the section of the excavation face 20 excavated by the depth of 50 cm to 100 cm (at step S420). When considering the installation environments, the width of the excavation face 20, and the quality of the soil, at this time, if there is a danger wherein the steel ribs 300 collapse, the steel ribs 300 installed on the top of the tunnel should be supported. Thus, post steel ribs 350 are further installed to support one side of centers of the steel ribs 300 disposed on the bottom and top of the tunnel, thereby reducing the danger of the collapse of the steel ribs 300 (at step S420'). In this case, the steel ribs 300 and the post steel ribs 350 make use of steel beams like H-beams.

Figure 12:
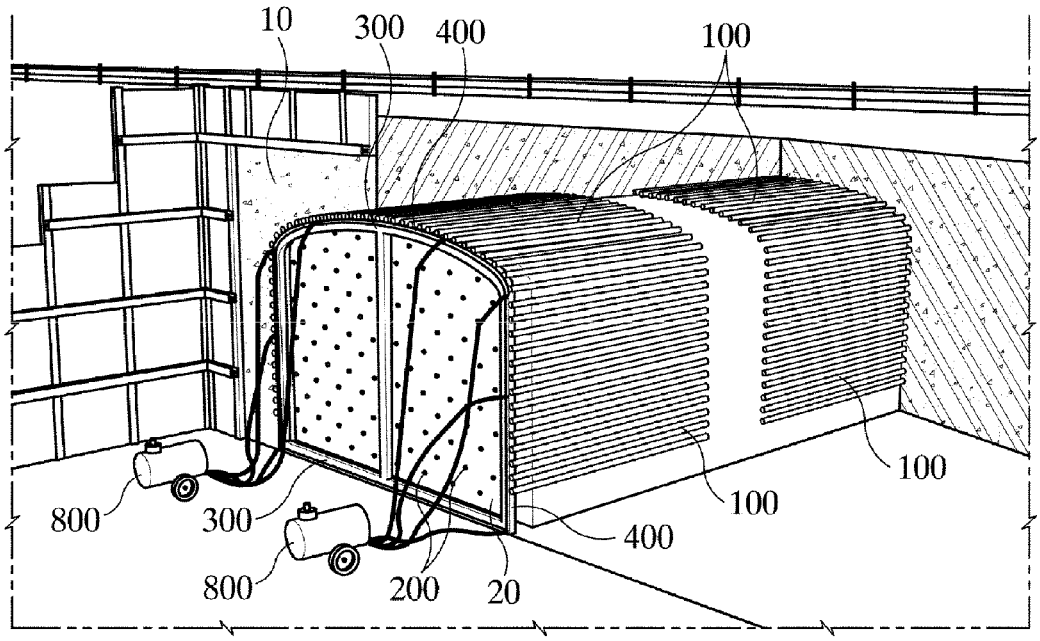
FIG. 12 is a perspective view showing the step 4-3 in the tunnel construction method according to the present invention, which is partially cut away.

FIG. 12 is a perspective view showing the step 4-3 in the tunnel construction method according to the present invention, which is partially cut away. As shown in FIGS. 10 to 12, pressurizing bags 400 are each provided between the steel ribs 300 and the excavated inner surface of the tunnel so as to recover the displacement of the excavation face 20 occurring through the excavation, and as shown in FIG. 12, the interior of each pressurizing bag 400 is filled with cement milk as a reinforcement material by means of cement milk injection devices 800 and is thus pressurized (at step S430). At this time, the pressurizing bag 400 is inserted between the outer surfaces of the steel ribs 300 and the excavated inner surface after the steel ribs 300 have been installed, and alternatively, it may be installed together with the steel ribs 300, while being attached to the flange portions of the steel ribs 300 by means of fastener tape or adhesive so as to enhance its attaching force. The material and shape of the pressurizing bag 400 have been already explained with reference to FIG. 4.

If the cement milk is injected into the pressuring bag 400, at this time, the internal pressure of the pressurizing bag 400 becomes gradually increased. The size of the internal pressure thereof corresponds to the size of the outward expansion of the inner surface of the tunnel with the repulsive force of the steel ribs 300. The internal pressure may be varied in accordance with the stiffness of an excavation ground 10, the height of the soil cover on the top of the tunnel and the allowance load of the steel ribs 300. Further, the pressurizing bag 400 is pressurized within the range wherein the addition of the ground load and the pressurizing force occurring through the advancement of the face of the tunnel is less than the allowance load of the steel ribs 300. The pressurizing bag 400 is dewatered by discharging water through the fabric tissues of the pressurizing bag 400, and after the dewatering, cement, additives and a small amount of water remain inside the pressurizing bag 400. Next, they are cured and hardened, and the hardened cement is under the pressurizing force occurring between the steel ribs 300 and the excavated inner surface of the tunnel. Also, if accelerator as additives is used, the water of the cement milk filled into the pressurizing bag 400 is discharged to the outside and rapid curing is carried out for between 30 seconds and one minute.

Figure 13:
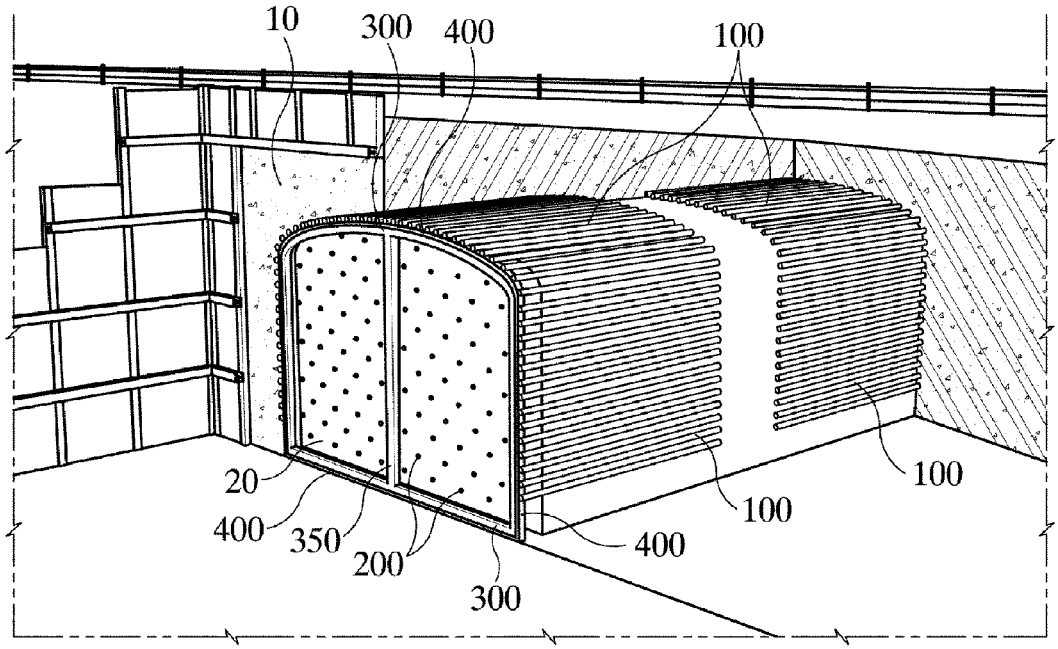
FIG. 13 is a perspective view showing a state wherein the step 4-1 is repeatedly performed in the tunnel construction method according to the present invention, which is partially cut away.

FIG. 13 is a perspective view showing a state wherein the step 4-1 is repeatedly performed in the tunnel construction method according to the present invention, which is partially cut away. As shown in FIG. 13, next, the rear side of the excavation face 20 on which the steel ribs 300 are installed is excavated again to a depth between 50 cm and 100 cm (at step S410).

Figure 14:
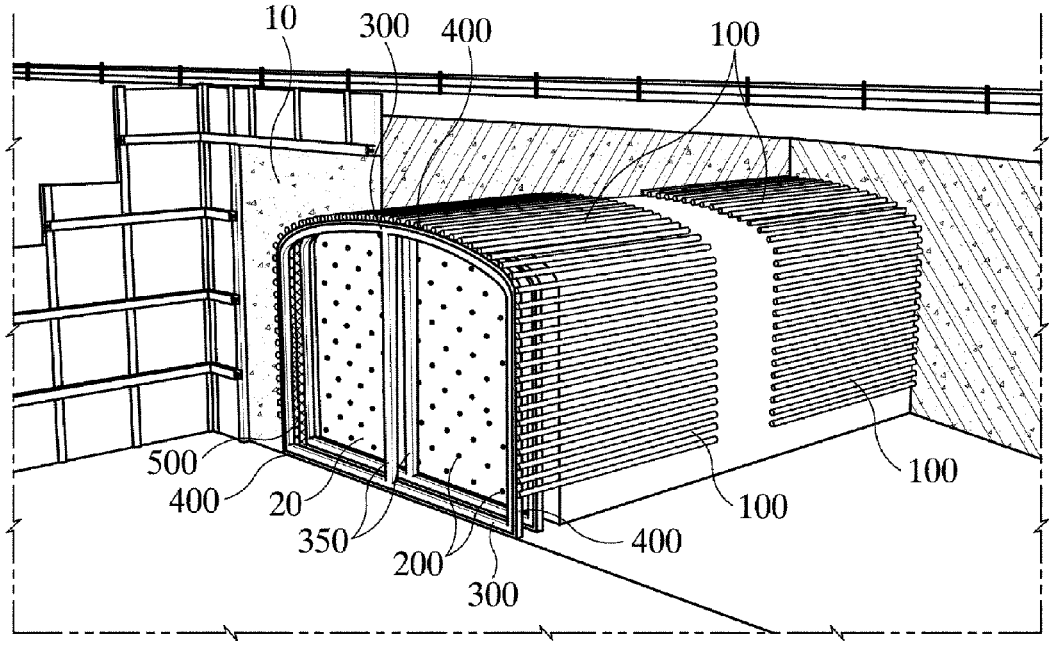
FIG. 14 is a perspective view showing a state wherein the steps 4-2 to 4-4 are repeatedly performed in the tunnel construction method according to the present invention, which is partially cut away.
Figure 15:
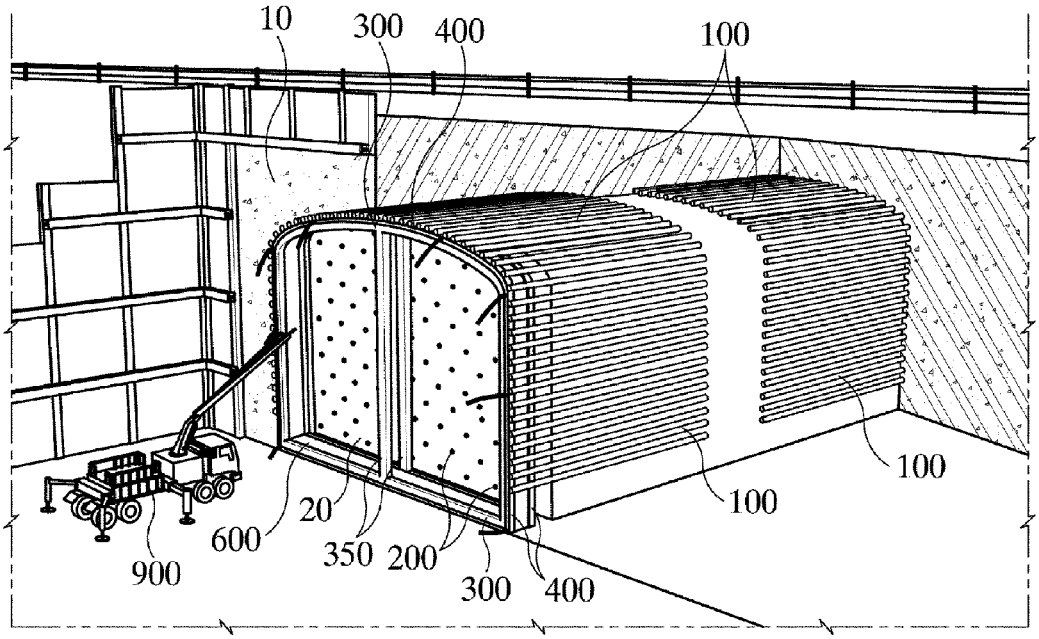
FIG. 15 is a perspective view showing a state wherein the step 4-4 is finished in the tunnel construction method according to the present invention, which is partially cut away.

FIG. 14 is a perspective view showing a state wherein the steps 4-2 to 4-4 are repeatedly performed in the tunnel construction method according to the present invention, which is partially cut away, and FIG. 15 is a perspective view showing a state wherein the step 4-4 is finished in the tunnel construction method according to the present invention, which is partially cut away. As shown in FIG. 14, the steel rib installation step (step 420) and the pressurizing bag installation step (S430) are carried out. After that, a steel cage 500 is inserted between the adjacent steel ribs 300, and, as shown in FIG. 15, shotcrete 600 is cast by a height of the steel rib 300 to the position where the steel cage 500 is inserted by means of a shotcrete casting device 900 (at step S440).

Next, the above-mentioned excavation step (step S410) to the shotcrete casting step (step S440) are repeatedly carried out up to a depth wherein the remaining lengths of the inserted reinforcements 100 are between 4 m and 8 m. Also, it is checked whether the remaining lengths of the front bolts 200 are less than 4 m or not. If the remaining lengths of the face bolts 200 are more than 4 m, the excavation step (step S410) is restarted, and contrarily, if they are less than 4 m, the face bolt installation step (step S300) is restarted.

Figure 16:
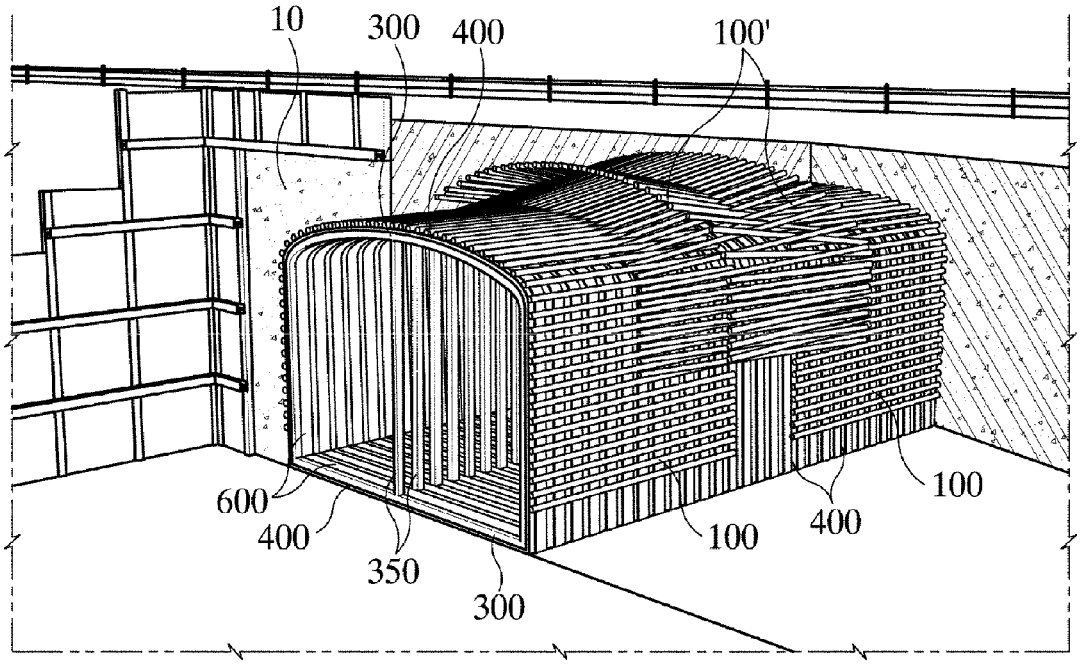
FIG. 16 is a perspective view showing a state wherein the step 4-5 is finished in the tunnel construction method according to the present invention, which is partially cut away.
Figure 17:
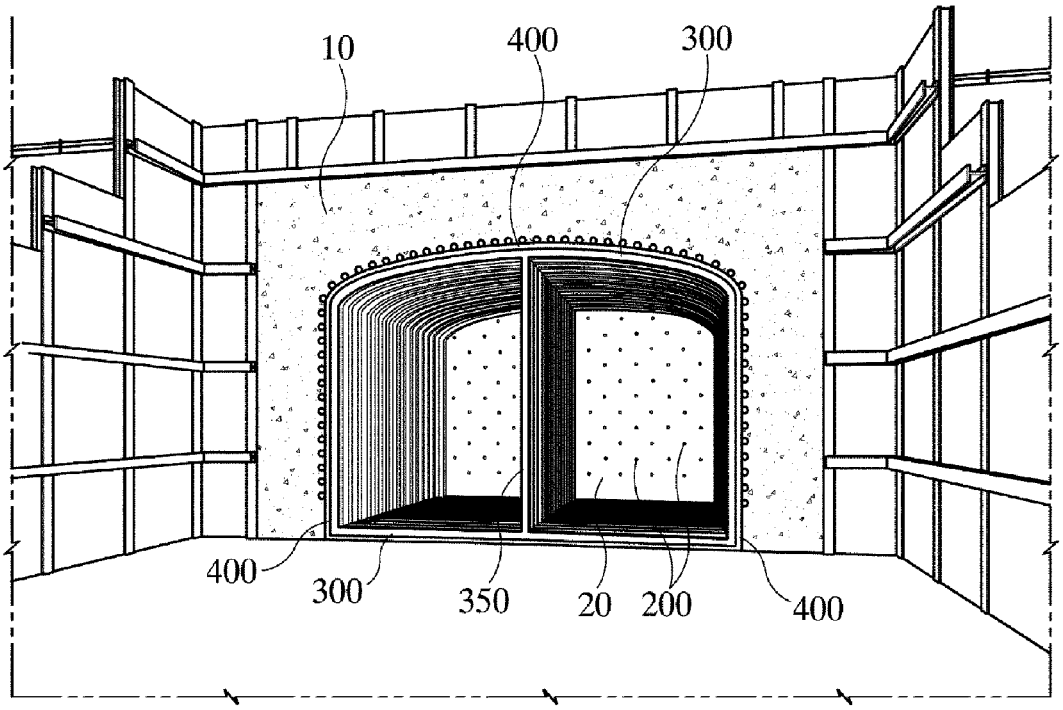
FIG. 17 is a front view showing a state wherein the step 4-5 is finished in the tunnel construction method according to the present invention.

FIG. 16 is a perspective view showing a state wherein the step 4-5 is finished in the tunnel construction method according to the present invention, which is partially cut away, and FIG. 17 is a front view showing a state wherein the step 4-5 is finished in the tunnel construction method according to the present invention. If the total excavation length is longer than length of one or two reinforcements 100, as shown in FIG. 16, auxiliary reinforcements 100' are additionally disposed between the respective reinforcements 100 from a point between 4 m and 8 m inwardly from the ends of the initially punched and inserted reinforcements 100 in such a manner as to be inclined by 8° to 12° from the excavation face 20 (at step S450). As the reinforcements 100 and the auxiliary reinforcements 100' are misaligned to one another, like this, they resist the external forces applied in a vertical or horizontal direction and the external forces locally generated, during excavation, as an integral body with each other, thereby improving the stability in the excavation.

Next, the interior of each auxiliary reinforcement 100' installed inclinedly is filled with cement milk (at step S460).

After that, the above-mentioned excavation step (step S410) to the shotcrete casting step (step S440) are repeatedly carried out up to a point wherein the excavation for the tunnel is finished. Also, if the lengths of the auxiliary reinforcements 100' are not enough, the auxiliary reinforcement installation step (step S450) is carried out again.

Figure 18:
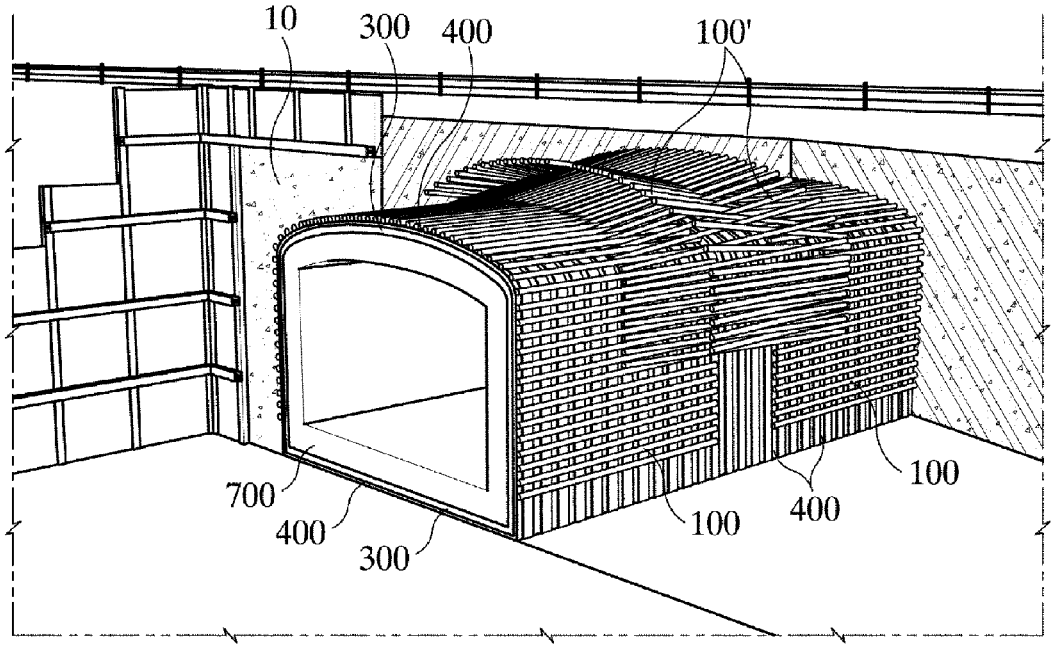
FIG. 18 is a perspective view showing a state wherein tunnel construction is finished in the tunnel construction method according to the present invention, which is partially cut away.
Figure 19:
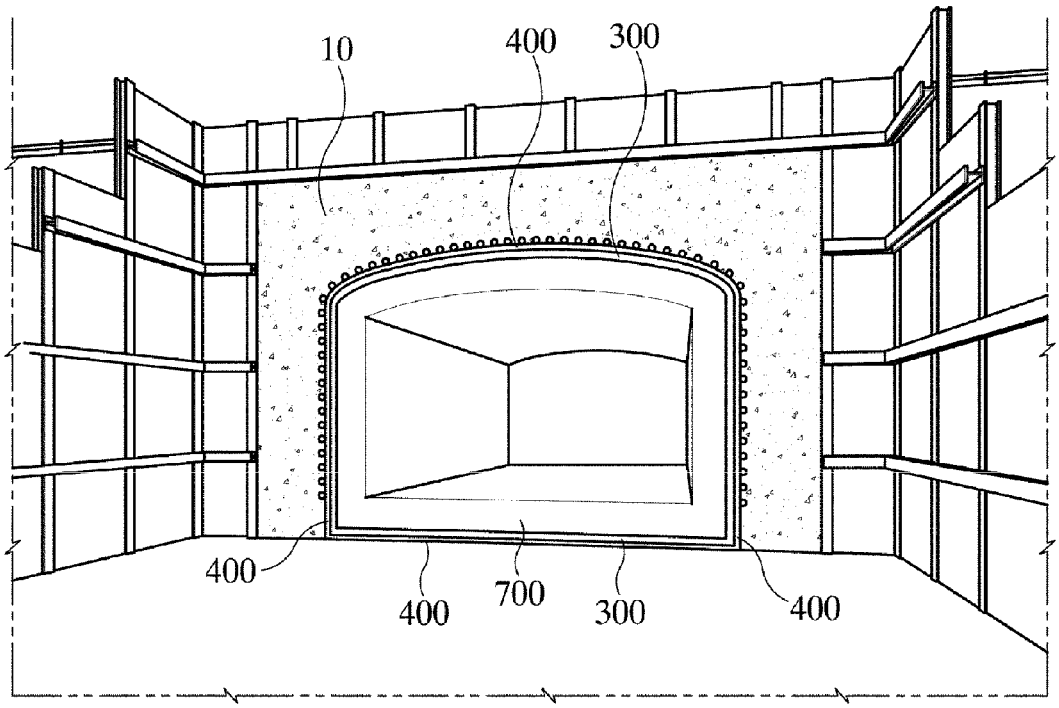
FIG. 19 is a front view showing a state wherein the tunnel construction is finished in the tunnel construction method according to the present invention.

FIG. 18 is a perspective view showing a state wherein tunnel construction is finished in the tunnel construction method according to the present invention, which is partially cut away, and FIG. 19 is a front view showing a state wherein the tunnel construction is finished in the tunnel construction method according to the present invention. As shown in FIGS. 18 and 19, if the excavation step (step S410) to the shotcrete casting step (step S440) are repeatedly carried out to finish the excavation, lining concrete 700 is cast to the steel ribs 300 and the inside of the shotcrete 600. If the post steel ribs 350 are installed, at this time, the lining concrete 700 is cast, while sequentially removing the post steel ribs 350.

The above-mentioned all steps may be carried out in one direction or in both directions from the tunnel to be excavated in accordance with the construction site states.

As mentioned above, there are provided the tunnel reinforcement structure and the tunnel construction method capable of controlling displacement using pressurization according to the present invention, wherein the pressurizing bag is installed in a gap between the steel ribs and the excavated inner surface of the tunnel under soft ground like soil or weathered rock or the excavated inner surface of the ground under a heavy structure; and the pressurizing bag is filled with the cement milk and thus pressurized by means of the filled cement milk, such that the ground displacement around the excavated face occurring upon the excavation is recovered and the stiffness of the recovered ground is increased by means of the pressurization of the pressurizing bag.

Further, a steel pipe reinforced ground method as one of auxiliary construction methods used generally in the tunneling construction is applied to the ground around the excavation face, and face bolts are installed on the front surface of the excavation face, such that the excavation can be immediately started, thereby obtaining a period of construction shorter by ⅓ than the existing method in which large diameter steel pipe insertion process is needed. Moreover, the pressurizing bag, which is inserted between the excavated inner surface and the steel ribs, is expanded by means of the reinforcement material, that is, the cement milk to apply the pressure to the excavated inner surface, such that the ground displacement occurring inside the excavation face can be restrained and the ground can be recovered to the original state.

According to the existing steel pipe forced insertion, large-sized steel pipes are forcedly inserted before excavation, and the interiors of the steel pipes are excavated and filled with concrete. Next, the steel pipes are previously installed under the ground, and after that, the ground under the steel pipes is excavated, thereby passively resisting the earth pressure caused by the excavation. So as to restrain the generation of the ground displacement to the highest degree, thus, large diameter reinforcements should be forcedly inserted into the ground to increase the stiffness. According to the present invention, however, since the pressurization is introduced to the excavation face, the steel ribs having relatively small stiffness like H-beams can be used as the supporting rods for the ground, without having any large sized steep pipes, thereby sufficiently restraining the generation of the ground displacement.

According to the present invention, additionally, the steel pipes having relatively small diameters than the conventional ones are adopted as the reinforcements adapted to vertically support the excavation face and to pr went the displacement of the excavation face from occurring, thereby easily delivering the materials for the construction. Further, as the steel pipes having relatively small diameters are used, no separate instruments like a reaction force plate, an oil jack and so on except for a reinforcement material insertion piercing instrument are needed, thereby permitting the construction to be well performed even in small space, achieving the simple construction, and reducing the period of construction and the construction costs. On the other hand, the reinforcement material like cement milk is injected into the reinforcements having small diameters, thereby ensuring the improvement of the strength and the reinforcement of the ground.

In addition, even though the tunnel has a deep depth, the auxiliary reinforcements are installed in the middle portion of the tunnel in such a manner as to be inclined by a given angle, thereby easily performing the construction.

Furthermore, the lining concrete can be replaced with the precast concrete previously made in a factory thereby having the construction costs and the period of construction lower and shorter than those needed when concrete is directly cast to the steel ribs and the inner surface of the shotcrete cast between the steel ribs.

Moreover, the installation of the face bolts prevents forming the excavation face from falling forward, even when the excavation is carried out only by the degree needed for the construction.

Additionally, the installation of the post steel ribs enables the construction to be stably carried out.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A tunnel construction method capable of controlling displacement using pressurization so as to excavate the ground or tunnel under a given structure, the tunnel construction method comprising the steps of:

(a) forcedly inserting a plurality of reinforcements into the bored holes formed along an outer surface of the section to be excavated of the tunnel in one direction or in both directions, so as to safely control the displacement of the tunnel, each of the reinforcements having a diameter in a range between 50 mm and 300 mm and a length in a range between 12 m to 40 m;

(b) injecting a reinforcement material in which cement milk is contained into the interior of each reinforcement;

(c) mounting a plurality of face bolts on an excavation face of the tunnel in an excavation direction so as to prevent the excavation face during excavation from collapsing or being displaced;

(d) excavating the tunnel;

(e) installing steel ribs on the excavated area of the tunnel;

(f) mounting a pressurizing bag between the steel ribs and the excavated inner surface of the tunnel and injecting cement milk into the pressurizing bag to pressurize the pressurizing bag;

(g) inserting a steel cage between the adjacent steel ribs and casting shotcrete to the steel cage;

(h) installing a plurality of auxiliary reinforcements disposed between the reinforcements from a point between 4 m and 8 m inwardly from the ends of the reinforcements forcedly inserted into the tunnel in such a manner as to be inclined by 8° to 12° from the excavation face, if the tunnel has a longer length than one or two reinforcements;

(i) injecting the reinforcement material into the auxiliary reinforcements installed inclinedly; and (j) after the steps (d) to (g) are repeatedly carried out until the excavation for the tunnel is finished, casting lining concrete to the steel ribs and the inner surface of the shotcrete, wherein at the step (a) the reinforcements are forcedly inserted into the bored holes formed along the outer surface of the section to be excavated on the tunnel in such a manner as to be spaced apart from each other by a distance between a diameter of each auxiliary reinforcement and 100 cm in a parallel direction to the excavation direction of the tunnel.

2. The tunnel construction method according to claim 1, wherein the face bolts are mounted spaced apart from one another by a distance between 1 m and 2 m.

3. The tunnel construction method according to claim 1, wherein the step (e) further comprises the step of (e') installing a post steel rib installed to support one side of centers of the steel ribs disposed on the bottom and top of the excavation face, so as to prevent the excavated portion of the tunnel from collapsing.

4. The tunnel construction method according to claim 3, wherein at the time of the step (j), the post steel ribs are removed sequentially in the casting process of the lining concrete or are removed all after the casting of the lining concrete.

5. The tunnel construction method according to claim 1, wherein after the step (i), the steps (d) to (i) are repeatedly carried out until the excavation for the ground or tunnel under the given structure is finished.

6. The tunnel construction method according to claim 1, wherein all of the steps are carried out in one direction or in both directions of the tunnel.

* * * * *